US006234307B1

(12) United States Patent
Beck

(10) Patent No.: US 6,234,307 B1
(45) Date of Patent: May 22, 2001

(54) GOLF BALL HOLDER

(75) Inventor: Peter Charles Beck, Victoria (AU)

(73) Assignee: Satimer Promotions Pty Ltd., Victoria (AU)

( * ) Notice: Subject to any disclaimer, the term of this patent is extended or adjusted under 35 U.S.C. 154(b) by 0 days.

(21) Appl. No.: 09/509,074

(22) PCT Filed: Sep. 16, 1998

(86) PCT No.: PCT/AU98/00763

§ 371 Date: May 22, 2000

§ 102(e) Date: May 22, 2000

(87) PCT Pub. No.: WO99/15243

PCT Pub. Date: Apr. 1, 1999

(30) Foreign Application Priority Data

Sep. 22, 1997 (AU) ..... 38398/97

(51) Int. Cl.[7] ..... B65D 85/58
(52) U.S. Cl. ..... 206/315.9; 224/919
(58) Field of Search ..... 206/315.1, 315.2, 206/315.9, 315.91; 224/919

(56) References Cited

U.S. PATENT DOCUMENTS 3,047,140 * 7/1962 Robins ..... 206/315.9
3,968,522 7/1976 Riess .
4,106,678 * 8/1978 Thomas ..... 206/315.9
4,296,874 10/1981 Evans .
4,433,803 * 2/1984 Liberboim ..... 225/919
4,730,728 * 3/1988 Larkin ..... 206/315.9
4,840,332 6/1989 Hoyt .
5,186,374 2/1993 Buxton .
5,634,557 6/1997 Shin et al. .
5,641,103 * 6/1997 Potik et al. ..... 224/919
5,839,631 * 11/1998 Herbert et al. ..... 206/315.9

* cited by examiner

*Primary Examiner*—Jim Foster
(74) *Attorney, Agent, or Firm*—Sughrue, Mion, Zinn, Macpeak & Seas, PLLC

(57) ABSTRACT

A holder for golf balls, said holder comprising a tube open at least at one end, said tube having an internal diameter less than the diameter of a golf ball and being composed of a resilient material which is able to expand when a ball is inserted into the tube, the characteristics of the material being such that a ball is inserted into the tube the tube will neck in front of and behind the ball whereby to retain the ball within the tube against accidental discharge through the open end.

6 Claims, 2 Drawing Sheets

GOLF BALL HOLDER

The present invention relates to a golf ball holder and more particularly to a golf ball holder which enables golf balls to be held securely or while permitting ease of dispense when required.

According to the present invention, there is provided a holder for golf balls, said holder comprising a tube open at least at one end, said tube having an internal diameter less than the diameter of a golf ball and being composed of a resilient material which is able to expand elastically when a ball is inserted into the tube, the characteristics of the material being such that when a ball is inserted into the tube, the tube will expand elastically and will neck in front of and behind the ball whereby to retain the ball within the tube against accidental discharge through the open end.

Figure 1:
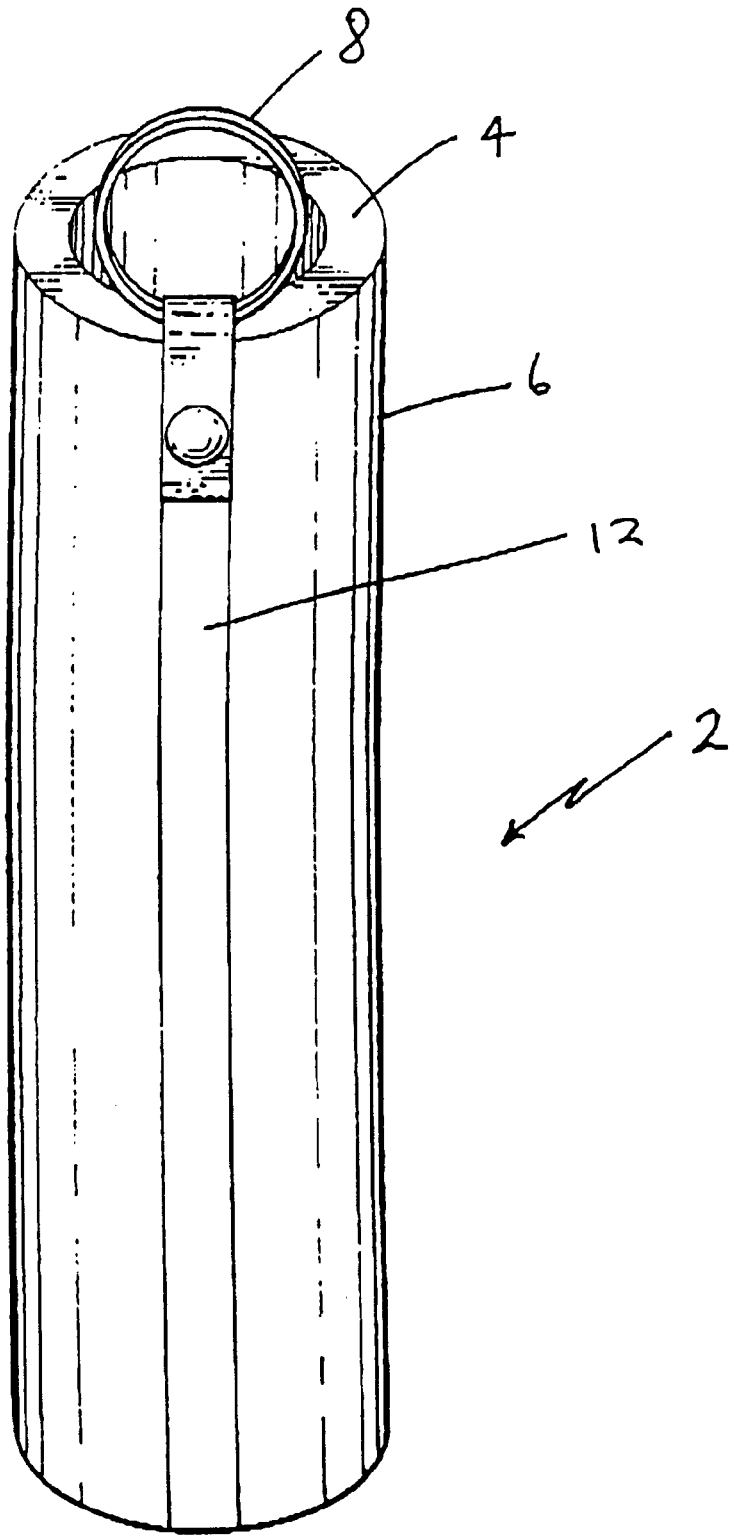
Figure 2:
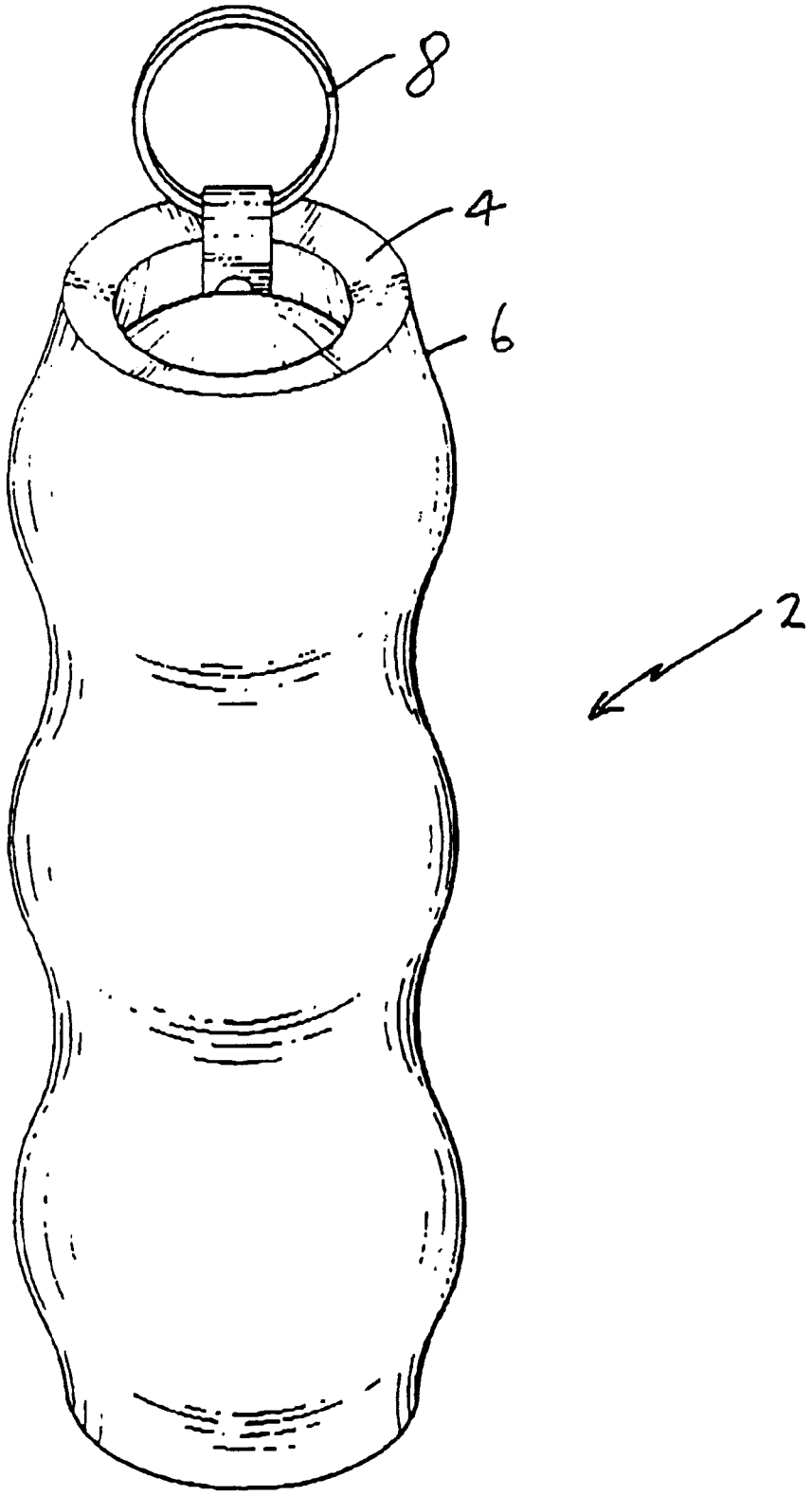

An embodiment of the invention will now be described, by way of example only, with reference to the accompanying drawings, in which:

FIG. 1 is a perspective view of a golf ball holder in accordance with a preferred embodiment of the invention shown in a condition prior to loading with golf balls; and FIG. 2 is a perspective view showing the holder when loaded with golf balls.

In accordance with a preferred embodiment of the invention, a golf ball holder 2 is of tubular form fabricated from an elastically-deformable composite material consisting of a resilient foam 4, laminated with a fabric material 6, the fabric 6 being at the outer surface of the tube. As shown, the tube is open at each end although in an alternative construction it may be open only at one end. Preferably, the foam 4 is a closed cell foam to prevent penetration of water through the wall of the tube. In one preferred form, the foam is composed of neoprene although other resilient plastics foams may alternatively be used. The internal diameter of the tube is somewhat less than the diameter of a standard golf ball (1.68 inches) whereby when a ball is inserted into the tube through one end the tube will expand circumferentially in order to retain the ball within the tube. However. the internal diameter of the tube must not be excessively smaller than the diameter of the ball otherwise insertion of the ball into the tub e becomes too difficult. We have found that an internal tube diameter of around 1.25 inches provides a sufficient opening size to facilitate insertion of the ball into the tube while enabling sufficient expansion to ensure that the ball is securely held within the tube against accidental dislodgement.

The covering of fabric 6 which is laminated to the foam 4 and which lies at the outer surface of the cube provides an important part in the functioning of the holder in the preferred embodiment as will now be described. The fabric 6 is a knitted fabric, the wales of the stitches being so oriented relative to the axis of the tube that the fabric permits greater elasticity in the axial direction of the tube than in the circumferential direction of the tube. In other words the tube is easier to stretch in its lengthwise direction than in its circumferential direction. As a result of this differential expansion capability, when a ball is inserted into the tube the tube tends to "neck" in front of and behind the ball whereby there is contact between the inner surface of the tube and the surface of the ball over a substantial arc length of the ball surface when considered in the axial direction of the tube and this ensures that the ball is securely held within the tube against unintended axial displacement. In the particular form shown, the tube is designed to hold three golf balls. FIG. 2 illustrates the configuration adopted by the tube when loaded with the three balls and the "necking" effect just described can clearly be seen in front of and behind each of the balls.

At its upper end the tube carries a ring 8 or other fastener for receiving a clip which enables the holder 2 to be hung from a golf bag or from a belt. The retention of the balls within the tube is such that when the tube is suspended approximately vertically the ball will not fall from the tube even when subjected to substantial shaking as may arise when a golf buggy is moving over rough ground. In order to remove a ball when required, all that is necessary is for the user to squeeze the tube behind the outermost ball and this will cause that ball to be expelled without displacing the other ball or balls within the tube.

The tube is fabricated by cutting a rectangular panel out of a sheet of composite foam/fabric material and then bending the panel into tubular form with the edges abutting to form a longitudinal seam which is held by application of a longitudinal strip 12 across the seam.

The fabric layer at the outer surface of the tube also enables the tube to be supplied in a range of different colours which can be printed with indicia such as manufacturer's names or logos or other promotional material.

Although the construction of a knitted fabric enables the required stretch capabilities to be achieved, other types of fabric constructed to provide a similar effect may alternatively be used, for example a woven fabric composed of elastic yarns.

Throughout this specification and claims which follow, unless the context requires otherwise, the word "comprise", or variations such as "comprises" or "comprising", will be understood to imply the inclusion of a stated integer or group of integers but not the exclusion of any other integer or group of integers.

The embodiment has been described by way of example only and modifications are possible within the scope of the invention.

What is claimed is:

1. A holder for golf balls, said holder comprising a tube open at least at one end, said tube having an internal diameter less than the diameter of a golf ball and being composed of a resilient material which is able to expand elastically when a ball is inserted into the tube, the tube will expand elastically and will neck in front of and behind the ball whereby to retain the ball within the tube against accidental discharge through the open end, wherein the tube is composed of a resilient foam material, and wherein the foam material is laminated with a fabric which lies at the outside of the tube, the fabric being such as to provide the tube with greater resilience in its axial direction than in its circumferential direction.

2. A golf ball holder according to claim 1, wherein the foam is a close cell foam.

3. A golf ball holder according to claim 1, wherein the fabric is a knitted fabric, with the wales of the stitches being oriented to provide greater resilience in the axial direction than in the circumferential direction.

4. A golf ball holder according to claim 1, wherein the fabric is a woven fabric including elastic yarns.

5. A golf ball holder according to claim 1, wherein the fabric is capable of being printed with indicia.

6. A golf ball holder according to claim 1, wherein the tube is open at each end and is fabricated by cutting a rectangular panel of said resilient material and folding the panel into tubular form to form a longitudinal seam with abutting edges.

* * * * *